United States Patent [19]

Kaiser

[11] 4,366,998

[45] Jan. 4, 1983

[54] TRADESMAN'S TOOL CARRIER AND SUPPORT STAND

[76] Inventor: David A. Kaiser, Rte. 2, Box 43A, Bowie, Tex. 76230

[21] Appl. No.: 196,471

[22] Filed: Oct. 14, 1980

[51] Int. Cl.[3] ..... A47B 81/00

[52] U.S. Cl. ..... 312/235 R; 312/138 A; 312/255; 312/286; 312/DIG. 33; 248/206 A

[58] Field of Search ..... 312/235 R, DIG. 33, 312/138 A, 286, 254, 255; 248/206 A; 190/16

[56] References Cited

U.S. PATENT DOCUMENTS

| | | | |
|---|---|---|---|
| 1,079,606 | 11/1913 | Rooney | 312/255 |
| 1,169,008 | 1/1916 | Chase | 312/235 R |
| 1,447,145 | 2/1923 | Morell | 312/235 R |
| 1,510,240 | 9/1924 | Myers | 312/DIG. 33 |
| 2,264,744 | 12/1941 | Dunnam | 312/235 R |
| 2,667,658 | 2/1954 | Cornick | 312/29 |
| 2,739,863 | 3/1956 | Ferris | 312/DIG. 33 |
| 3,051,540 | 8/1962 | Wood | 312/280 |
| 3,099,398 | 7/1963 | Croteau | 312/235 R |
| 3,322,310 | 5/1967 | Higgs | 312/DIG. 33 |
| 3,407,899 | 10/1968 | Delafrange | 312/235 R |
| 3,540,576 | 11/1970 | Pierce | 190/16 |
| 3,749,301 | 7/1973 | Peckar | 248/206 A |
| 4,085,987 | 4/1978 | Vartdal | 312/DIG. 33 |
| 4,285,556 | 8/1981 | Loeffel | 312/DIG. 33 |

FOREIGN PATENT DOCUMENTS

| | | | |
|---|---|---|---|
| 764061 | 12/1956 | United Kingdom | 312/DIG. 33 |

*Primary Examiner*—Victor N. Sakran
*Attorney, Agent, or Firm*—Stephen D. Carver

[57] ABSTRACT

A combination tool carrier and support stand adapted for use by tradesmen such as carpenters, and electricians and the like. The device includes a rigid, generally rectangular base including a plurality of downwardly projecting, spaced-apart feet adapted to be disposed upon a solid supporting surface, a generally rectangular top secured above the base by a tapered frame, and a pair of side doors hingeably coupled to the frame. An internal partition separates the carrier into two separate storage regions, and bolt regions are provided with a plurality of individual compartments for receiving and temporarily housing various hand tools and accessories. Preferably the inner surface of each door includes additional tool storage compartments. A non-slip surface secured to the top facilitates safe use of the carrier as a stand.

1 Claim, 7 Drawing Figures

TRADESMAN'S TOOL CARRIER AND SUPPORT STAND

BACKGROUND OF THE INVENTION

The present invention relates generally to tool boxes and the like. More particularly, the present invention is related to an internally compartmentalized tool box adapted to be used as a stand or support stool by a tradesman.

As will be recognized by those skilled in the various trades, possession of a rugged and functional tool box is vitally important. In the practice of carpentry, for example, several dozen tools, fittings and miscellaneous items must be readily accessible in order to efficiently complete most jobs. Access to a convenient stool which will allow the tradesman to sit when necessary and which will doubly function as a safe step stool for reaching elevated positions is certainly advantageous. Most tradesman are limited in the amount of tools they can carry by the storage capacity of their truck, van or other business vehicle. For this reason it is highly desirable to combine a stool which can be safely used on the job with a tool carrier with sufficient internal volume to properly house required tool and equipment.

In the prior art a variety of combined tool carrier and stool devices have been suggested. For example, the general principal is illustrated by U.S. Pat. Nos. 3,051,540; 3,407,899; 1,169,008; and 2,667,658.

While various internal storage compartments have been employed in the prior art, it is important to maintain a low center of gravity whereby to increase the stability of the stool. Along these lines, it is important that access doors by symmetrical and that they do not unbalance the stand, whether they are open or closed. Finally, it is important that the upper supporting surface should be protected against inadvertent slipping, whereby to prevent falling or tripping.

SUMMARY OF THE INVENTION

The present invention comprises a rigid, generally rectangular base supported by a plurality of downwardly projecting feet. A generally rectangular top is supported above the base by an upwardly tapered frame. A pair of similarly shaped, generally rectangular side doors are hingeably coupled to the frame at the bottom thereof and may be conveniently moved between open and closed positions. An internal planar partition extends vertically between the top and the frame support base to reinforce the device and divide it into two internal volumes.

Each internal volume is provided with a plurality of individual storage compartments or receptacles for temporarily receiving tools, parts, or other items used by the tradesman. Inner recessed portions of the doors are also equipped with compartments to similarly receive tools and the like. The doors open outwardly and downwardly to facilitate user convenience. The top of the device preferably includes a non-slip or non-skid surface such as a carpet fabric or the like, whereby to prevent inadvertent slipping when the tool carrier is used as a support or stand.

Thus a broad object of this invention is to provide a combination tool carrier and support device which may be efficiently used by a tradesman.

A similar object of this invention is to provide a rugged and durable tool carrier ideally adapted to store tools of a tradesman in an orderly fashion.

Yet another object of the present invention is to provide a tool carrier of the character described which may be conveniently employed as a stand or a seat.

A still further object of the invention is to provide a combination tool carrier stand which may be easily opened and reached into while functioning simultaneously as a seat.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views.

DETAILED DESCRIPTION OF THE DRAWINGS

Figure 1:
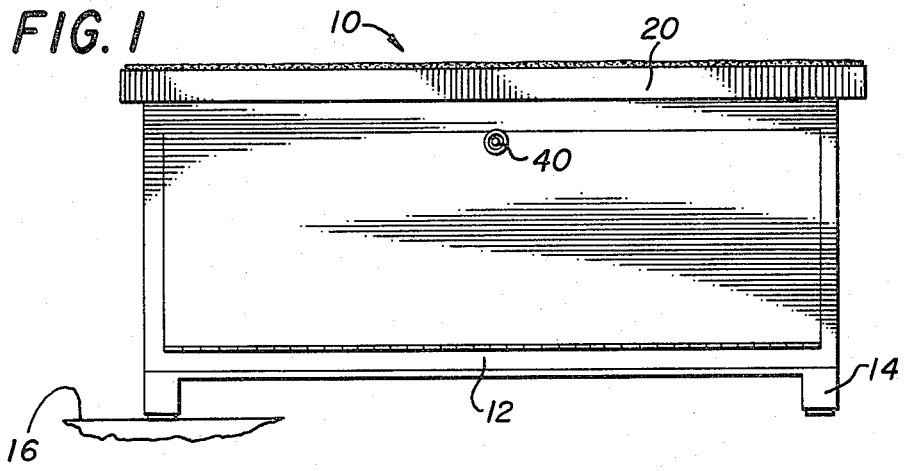
FIG. 1 is a side elevational view of the combination tool carrier and support stand constructed in accordance with the teachings of this invention.

With reference not to the appended drawings, a combination tool box and support stand constructed in accordance with the teachings of this invention is illustrated generally by the reference numeral 10. The combined carrier and stand includes a lower, generally rectangular base 13 including a plurality of spaced-apart downwardly projecting feet 14 adapted to be disposed upon a preferably solid supporting surface 16. Each of the feet 14 include lower non-skid surfaces 15. The entire apparatus is preferably constructed of wood and conventional finishing techniques may be employed.

A pair of tapered planar end walls 18, 19 extend vertically upwardly from opposite ends of frame 12. A rigid, generally rectangular top panel portion 20 is secured on top of the carrier 10, and includes an upper, outer non-skid surface 22 of carpet or the like. An enclosure is defined between rectangular base plate 13, top 20, end walls 18, 19 and doors 30, 32.

Figure 2:
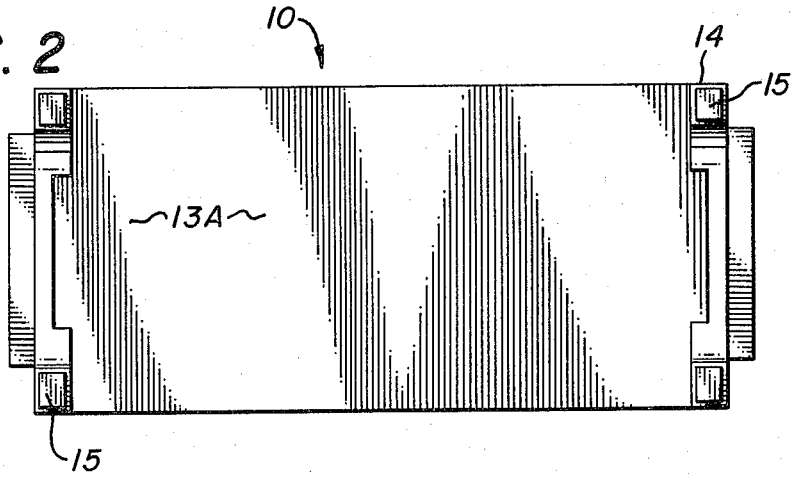
FIG. 2 is a bottom plan view thereof.
Figure 3:
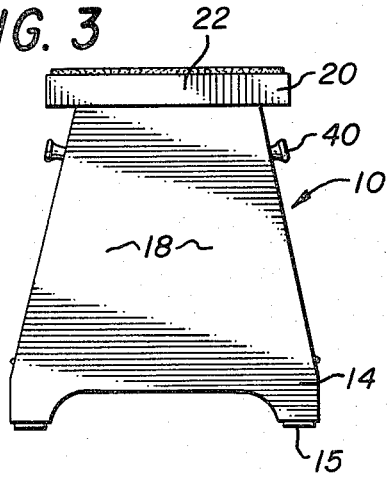
FIG. 3 is an end view of the invention.
Figure 5:
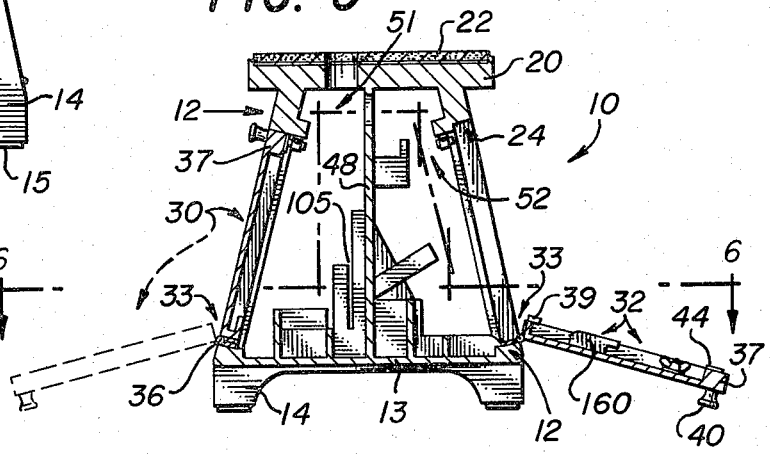
FIG. 5 is a sectional view of the invention taken generally along the line 5—5 of FIG. 4.
Figure 4:
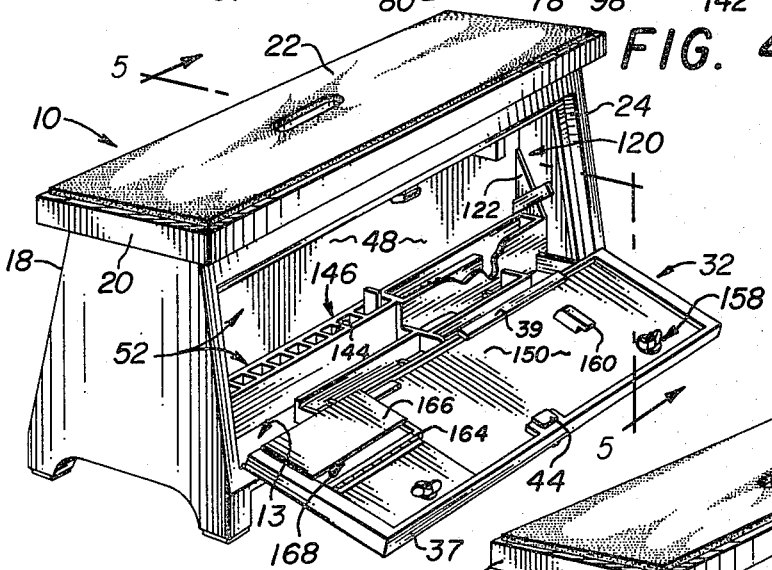
FIG. 4 is an isometric view of the invention illustrated with one of the doors in an open position.
Figure 7:
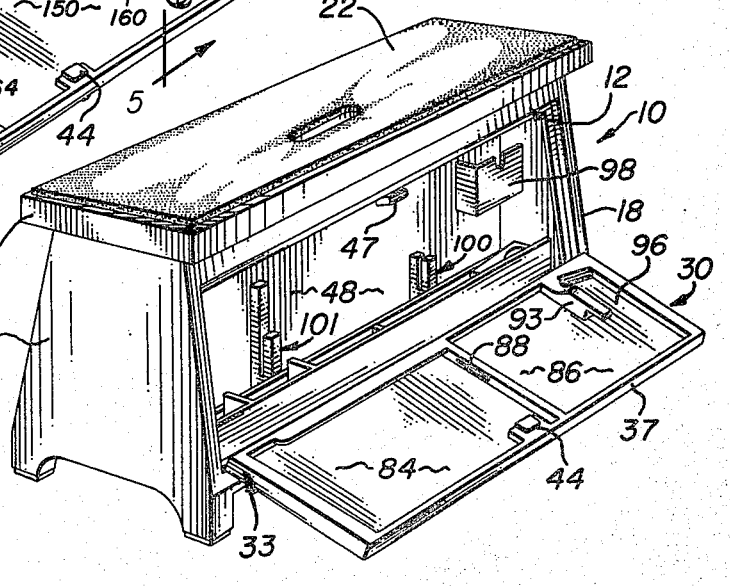

As best viewed in FIGS. 4, 5 and 7, the frame 12 formed between end walls 18, 19, lower base 13, and top 22 is recessed as illustrated at 24, 25 whereby to snuggly receive each of the generally rectangular side doors 30, 32. Each of the doors are of similar, generally rectangular dimensions, and each includes a lowermost edge portion 33 adapted to be coupled to frame 12 via similar elongated, conventional hinges 36, longitudinally secured at opposite bottom edges of the device. The top portions 37 of each door include knobs 40 mounted thereon for convenient user manipulation. The knobs 40 are secured to portions 37, generally opposite a magnetically attractable steel portion 44 which, when the door is moved to the closed position, will be attracted and yieldably secured by a permanent magnet 47 secured to frame 12 internally of the enclosure. Because of the recesses 24, 25 it will be apparent that when either door 30, 32 is moved to the closed position (illustrated in FIGS. 1-3), a smooth profile will be maintained since doors snuggly fit within the frame.

An internal, generally planar, vertically oriented partition 48 extends upwardly from base plate 13 into abuttment with top 20. Plate 40 thus reinforces and strengthens the device, while dividing the interior into two separate volumes or regions 51, 52. It will also be appreciated that partition 48 secures a plurality of elevated compartments or structural members to facilitate storage of tools and accessories.

Figure 6:
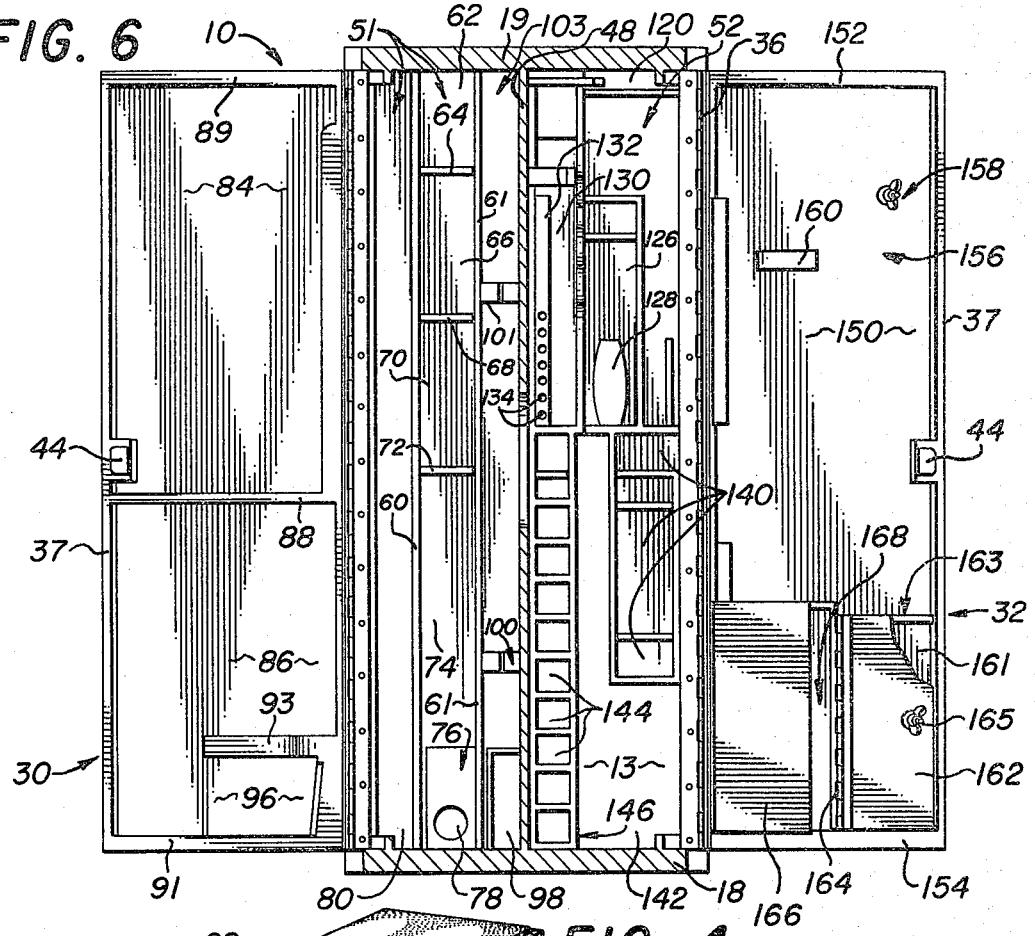
FIG. 6 is an enlarged, sectional view of the invention taken generally along line 6—6 of FIG. 5, with both doors illustrated in an open position; and, FIG. 7 is an isometric view of the invention similar to FIG. 4, but illustrating an opposite side of the invention.

With primary reference now to FIG. 6, inner regions 51, 52 include a plurality of individual compartments for receiving tools, supplies parts or the like. To this effect region 51 is divided into a plurality of compartments defined between internal partitions 60, 61, which extend longitudinally within the carrier 10 parallel with spaced-apart partition 48. A glue bottle receptacle 62 is formed between panel 60, 61 and a transverse partition 64. An adjacent region 66 defined between partitions 60, 61, 64, and 68 is adapted to receive a sanding block. Compartment 70 defined between partition 68, 72, and sides 60, 61 is adapted to receive a jar or other removable container of nails, screws, or the like. A somewhat longer, linearly adjacent region 74 may receive a folding rule, and subcompartment 76 therewithin will conveniently store a hammer. To this effect depression 78 is formed to receive the hammer head, and the handle may lay rearwardly within compartment 74. Alternatively a nail bar may be stored in subsection 74. An internal, elongated subcompartment 80 located between door 30 and partition 60 may conveniently store elongated rod like tools such as ratchet wrenches, extensions and the like.

Region 51 also includes a chalk box 98 secured to wall 48 (FIG. 7) in spaced relation with respect to bottom 13. Saw blade holders 100 disposed within region 103 are attached to wall 48 and including narrow slots 105 for receiving narrow blades or similar articles. Door 30 includes a pair of spaced-apart recessed portions 84, 86 separated from each other by a partition 88 which extends between outer door lid 37 and its inner edge 39. Region 84, which is ideally suited for storing miscellaneous tools and supplies, is defined between partition 88 and door end 89. Region 86, which may preferably store or house a key hole saw is defined between a partition 88 and door end 91. Region 86 is subdivided by a protrusion 93 which separates a smaller region 96 which is adapted to receive the handle of a key hole saw and to maintain it in proper position during storage.

Internal region 52 is also divided into a plurality of individual subcompartments. A compartment 120 defined between an upwardly vertically extending triangular partition 122 and the end wall 19 defines a region for receiving a pair of plyers. A pair of metal cutters or snippers may be disposed within subcompartment 126, the handles of the cutters being conveniently placed about and on either side of vertically upwardly rising spacer 128. A compartment 130 adjacent compartment 126 is adapted to receive a tool such as a ratchet drive nut or screw driver, and frame member 132 is provided with a plurality of orifices 134 for receiving individual drive fittings. A plurality of compartments 140 are included to house screws, bolts and miscellaneous parts. A sharpening stone and sissors may be conveniently placed within adjacent compartment 142. A plurality of individual, sequentially aligned subcompartments 144 defined within a generally vertically offset housing 146 are adapted to receive a plurality of wood chissels of various sizes, a putty knife, or variously sized screw drivers.

Door 32 also includes a recessed interior 150 defined between upper lid portion 37 and opposite ends 152, 154. A saw or other hand tool may be stored within a first internal space 156 by a wing nut assembly 158, the saw being secured within a receptacle 160 forming a blade receptive notch.

A compartment 163 secured interiorly of main door 32 includes a door 162 operatively secured via a hinge 164. Wing nut 165 may be removed as desired to open compartment 161 for storage of saw blades or other articles. A similar compartment 166 is disposed within the recessed region 150 of door 32 for storing other odds and ends.

Thus the present invention may be utilized to store a variety of tools or parts commonly used in the building trade. It will be apparent that when the device is disposed upon a supporting surface, its relatively broad lower base will maintain stability and present a low center of gravity. While the owner is seated on the device, he may simultaneously open either door for immediately internal access. While standing on the device secure footing will be encouraged by the non-slip surface 22 and the rigid feet 14.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A tool carrier and support stand for carpenters, tradesman and the like, the device comprising:

a rigid frame including a generally rectangular, rigid, planar base having a predetermined width and length and including a plurality of downwardly projecting, spaced apart supportive feet adapted to be disposed upon a solid supporting surface, each of said feet including non-skid surfaces provided at their undersides for frictionally contacting said supporting surface;

a rigid, generally rectangular planar top parallel with said base and spaced-apart therefrom, the top having a length substantially equal to said base length, a width smaller than said base width, and an upper surface;

a generally planar layer of non-skid fabric material secured to said outer, upper surface of said top for preventing a user of said device from slipping when using the device as a stool or chair;

a pair of parallel, spaced-apart, generally triangular end walls extending between said base and said top, the width of said walls decreasing towards said top;

a pair of generally rectangular, similarly shaped planar doors hingeably coupled at opposite bottom sides of said device and forming side walls thereof when in a closed position, the doors manually displacable between a substantially horizontally oriented open position whereby to selectively facilitate user access to the interior of the device, and, when in said closed position, flushly nested within suitable door receptive recesses provided in said frame, said doors each including interiorly recessed sides provided with a plurality of storage compartments or pockets;

a rigid, fixed internal, planar reinforcement partition extending vertically between said base and said top, said partition occupying a plane perpendicularly bisecting said top, said bottom, and both of said end walls, whereby to divide the interior of said device into two regions of equal volume and symmetrical geometry while bracing said top to facilitate use of said device as a support stand;

a plurality of separate, generally spaced-apart compartments defined interiorly of the device for storing tools and the like; and, magnetic latch means for yieldably maintaining said doors in a closed position.

* * * * *